United States Patent [19]

Hansen et al.

[11] 4,054,119

[45] Oct. 18, 1977

[54] ARCHERY BOW WITH ADJUSTABLE ARROW REST

[76] Inventors: Jep F. Hansen; Albert L. Hansen, both of P.O. Box 1249, Grants Pass, Oreg. 97526

[21] Appl. No.: 652,708

[22] Filed: Jan. 26, 1976

[51] Int. Cl.[2] ..... F41B 5/00

[52] U.S. Cl. ..... 124/24 R; 124/41 A; 124/88; 248/274

[58] Field of Search ..... 124/41 A, 23 R, 24 R, 124/86, 88; 248/204, 242, 288 R, 291, 274

[56] References Cited

U.S. PATENT DOCUMENTS

| | | | |
|---|---|---|---|
| 1,703,059 | 2/1929 | Carpenter | 248/204 X |
| 2,219,039 | 10/1940 | Street | 248/204 |
| 2,574,038 | 11/1951 | Howard | 248/242 X |
| 2,580,947 | 1/1952 | Pacilio | 248/204 |
| 3,292,607 | 12/1966 | Hoyt | 124/41 A |
| 3,672,347 | 6/1972 | Allen | 124/41 A |
| 3,871,352 | 3/1975 | Stanislawski et al. | 124/41 A |
| 3,918,428 | 11/1975 | Wilson et al. | 124/41 A |

*Primary Examiner*—Richard C. Pinkham
*Assistant Examiner*—William R. Browne
*Attorney, Agent, or Firm*—Clarence A. O'Brien; Harvey B. Jacobson

[57] ABSTRACT

A generally inverted U-shaped member is provided and includes a pair of side-by-side legs interconnected at one pair of corresponding ends by an integral bight portion. The member is constructed of stiff, but resilient material whereby the free end portions of the legs may be spread, at least slightly, apart and therafter allowed to return to their original predetermined spaced relationship. One of the legs includes structure for attachment of that leg to a selected side of the mid-portion of a bow with the other leg spaced outwardly from that side of the bow. The free end portion of the other leg includes an outwardly projecting arrow rest element extending away from the leg attached to the bow and adjustable spacing structure is interconnected between the legs of the U-shaped member for adjustably increasing the spacing between the free end portions of the legs in excess of the predetermined spaced relationship thereof.

10 Claims, 4 Drawing Figures

ARCHERY BOW WITH ADJUSTABLE ARROW REST

BACKGROUND OF THE INVENTION

Various forms of arrow rests have been heretofore designed for various types of bows. Some of these arrow rests are primarily concerned with compensating for varying distances between the bow and the target and others include structure operable to effect windage adjustments. However, few arrow rests are constructed to provide both windage and distance adjustments and those previously known arrow rests which do provide for both windage and distance adjustments are reasonably complex in structure and are sometimes difficult to adjust as desired.

Examples of arrow rests capable of performing some of the objects of the instant invention are disclosed in U.S. Pat. Nos. 2,980,097, 3,318,289, 3,672,347 and 3,769,956.

BRIEF DESCRIPTION OF THE INVENTION

The arrow rest structure of the instant invention comprises a simple U-shaped body constructed of stiff but resilient material, an arrow rest element projecting outwardly from one leg of the U-shaped member or body and an abutment member carried by a first leg of the attachment adjustable toward and away from and engageable with the other leg of the attachment for varying the spacing between the free ends of the legs of the attachment. The leg of the U-shaped member opposing the leg equipped with the arrow rest element includes structure whereby it may be attached to one side of a bow and the attaching structure is such whereby the arrow rest structure may be supported from either side of a bow thereby enabling that attachment to be used on bows designed to be used by both right-handed persons as well as left-handed persons.

The main object of this invention is to provide an arrow rest structure for a bow including adjustment means whereby adjustments for windage and target distance may be readily accomplished.

Another important object of this invention, in accordance with the immediately preceding object, is to provide an arrow rest structure which may be readily attached to bows designed for left-handed persons as well as bows designed for right-handed persons.

Another important object of this invention is to provide an arrow rest structure constructed in a manner whereby it may be readily attached to arrows equipped with a sight window or devoid of a sight window.

It is also an object of this invention to provide an arrow rest structure including attaching structure whereby it may be secured to an associated bow without any modifications to the bow being required.

A final object of this invention to be specifically enumerated herein is to provide an arrow rest structure in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
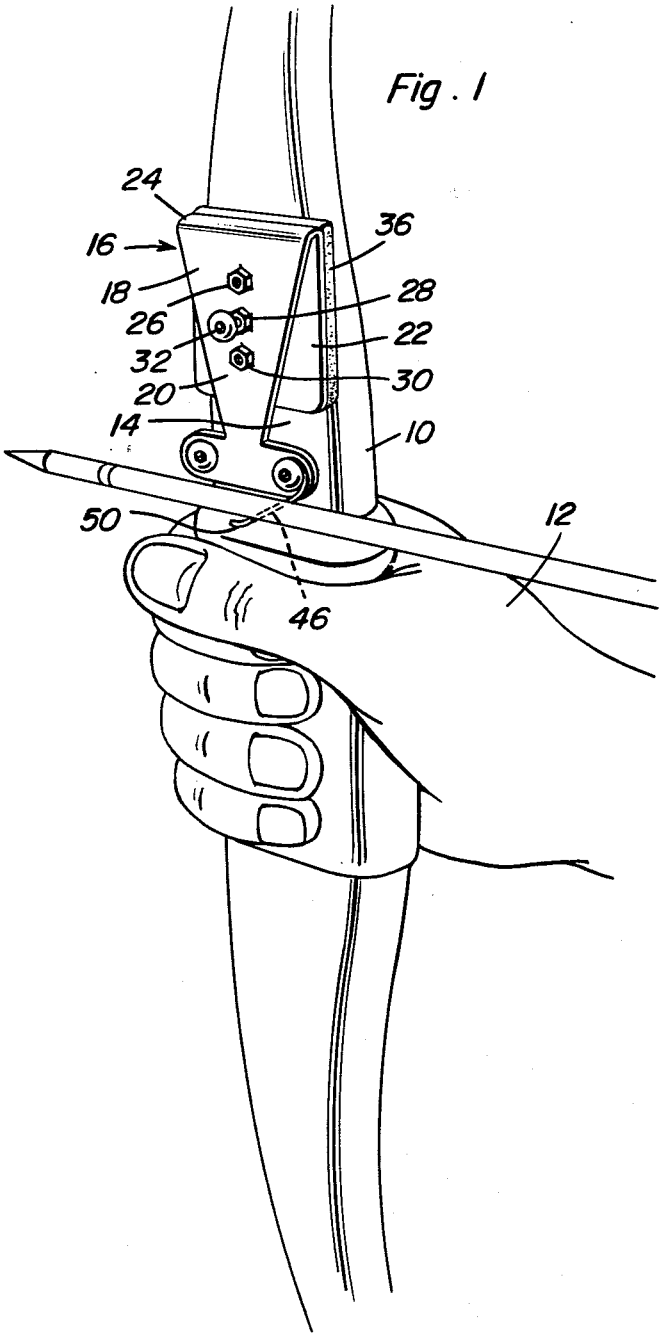
FIG. 1 is a fragmentary perspective view of a with the arrow rest structure of the instant inve operatively associated therewith.

Referring now more specifically to the drawi numeral 10 generally designates a conventional archery bow including a grip portion to be enci one hand 12 of the user of the bow 10. The includes a side surface 14 spaced above the h encircled by the hand 12, and the arrow rest stru the instant invention is referred to in general reference numeral 16 and is mounted on the sid 14.

Referring now more specifically to FIGS. 1 the drawings it may be seen that the arrow r ture 16 comprises a U-shaped body 18 const substantially constant thickness strap materia cluding a pair of first and second legs 20 and are disposed in side by side spaced relation connected at one pair of corresponding ends t means of an integral bight portion 24.

Figure 3:
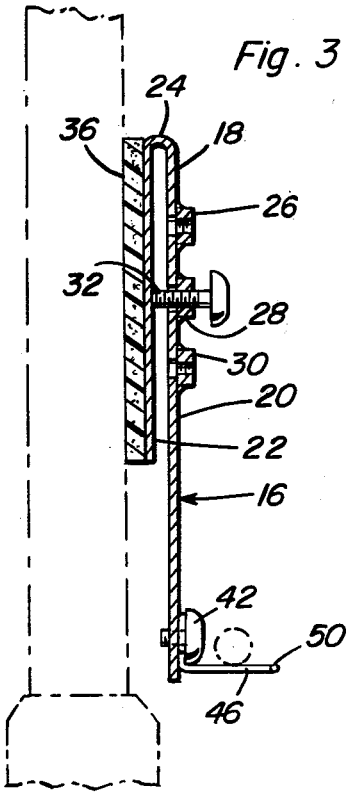
FIG. 3 is a vertical sectional view taken substa upon the plane indicated by the section line 3- FIG. 2.

The material of which the body 18 is cons stiff but resilient and the legs 20 and 22 su parallel each other when the body 18 is i position. However, the base end portion of includes three internally threaded boss porti and 30 spaced longitudinally therealong an threaded bores extending through the leg 20 shank-type abutment member 32 is pro threaded through a selected one of the boss 28 and 30, the abutment member 32 bein through the boss portion 28 in FIG. 3. The abutment member 32 adjacent the leg 22 ab and accordingly, if the abutment member threaded through the boss portion 28 the tween the legs 20 and 22 will be increased.

The outer side of the leg 22 remote fro includes a layer or pad of adhesive materia thereto and by which the arrow rest str secured to the surface 14 of the arrow 10.

Figure 2:
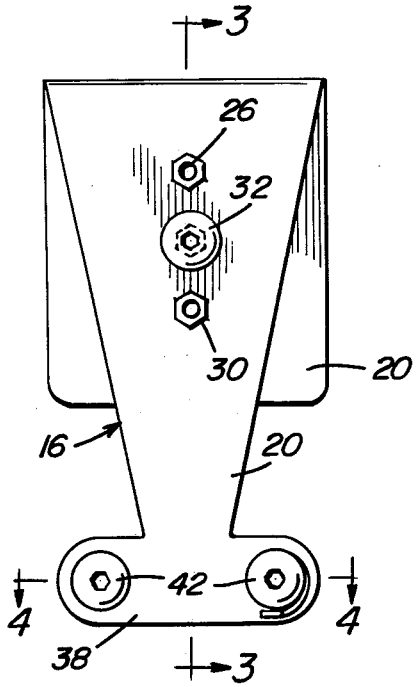
FIG. 2 is a side elevational view of the arrov structure on somewhat of an enlarged scale.
Figure 4:
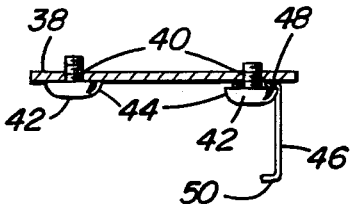
FIG. 4 is a horizontal sectional view taken su tially upon the plane indicated by the section lin of FIG. 2.

From FIGS. 2 and 4 of the drawings it that the free lower end of the leg 20 incl versely enlarged head 38 and that the op the head 38 include threaded bores 40 f through. A threaded and headed shank ty is threadedly secured through each bore fastener 42 includes a head 44. Supported 38 is a wire arrow rest element 46 incl angularly directed integral eye 48 on c similarly right-angularly directed termin 50 on the other end. The eye 48 of the ment 46 is clamped under the head 44 fastener 42 with the eye 48 in adjusted r whereby the elevation of the arrow r relative to the head 38 is predetermined ll rest element 46 may be varied as desired.
ıen the arrow rest structure 16 is supported from
ırface 14 the arrow rest element 46 is supported
the fastener 42 threaded through the rearmost
10. Of course, if the arrow rest structure 16 is
ed on the opposite side of the bow 10, the eye 48
arrow rest element 46 will be anchored beneath
ıd 44 of the other fastener 42.
djusting the abutment member 32 windage ad-
ıts in the flight of the arrow to be launched from
v 10 may be accomplished and the abutment
32 may be threaded through the boss portion
ıt tension of the lower end portion of the leg 20
ıich the arrow rest element 46 is supported is
However, if medium tension is desired the abut-
nber 32 is threaded through the boss portion 28
ıvy tension of the lower end portion of the leg
vhich the arrow rest 46 is supported is desired
ıent member 32 is threaded through the boss
).

egoing is considered as illustrative only of the
of the invention. Further, since numerous
ons and changes will readily occur to those
he art, it is not desired to limit the invention
ct construction and operation shown and
and accordingly all suitable modifications
lents may be resorted to, falling within the
e invention.

laimed as new is as follows:

ıbination with a bow having a hand grip
l-portion, an arrow rest structure including
generally U-shaped member including first
ide-by-side legs including upper and lower
e end portions, respectively, and intercon-
eir base ends by means of an integral bight
ıding therebetween, said U-shaped member
ucted of stiff, but resilient material whereby
portions of said legs may be spread, at least
ırt and thereafter allowed to return to their
ced relationship, attaching means attaching
; to the mid-portion of said bow with said
nding along said mid-portion and with said
paced outwardly of one side of said mid-
ree end portion of said second leg including a laterally outwardly projecting arrow rest element extending in a direction away from said first leg, and adjustable spacing means carried by one of said legs intermediate the base and free ends thereof and engaged with the other leg for adjustably increasing the spacing between said free end portions in excess of the original spaced relationship thereof.

2. The combination of claim 1 wherein said adjustable spacing means abuts the side of said other leg free end portion and is adjustable relative to said one leg free end portion along a path extending between said leg end portions.

3. The combination of claim 1 wherein said adjustable spacing means includes a threaded abutment member threadedly supported from said one leg free end portion and abutted against the adjacent side of said other leg free end portion.

4. The combination of claim 1 wherein said first leg comprises said other leg.

5. The combination of claim 4 wherein said adjustable spacing means includes a threaded abutment member threadedly supported from said second leg free end portion and abutted against the adjacent side of said first leg free end portion.

6. The combination of claim 1 wherein said second leg and said arrow rest element include coacting means for adjustably positioning said element on opposite sides of the same surface of a plane containing said second leg.

7. The combination of claim 6 wherein said adjustable spacing means includes a threaded abutment member threadedly supported from said second leg free and abutted against the adjacent side of said first leg.

8. The combination of claim 1 wherein said one leg includes a plurality of vertically spaced apertures formed therethrough, said adjustable spacing means comprising an abutment member adjustably secured through one of said apertures.

9. The combination of claim 8 wherein said abutment member comprises a threaded shank member threaded through said one of said plurality of said apertures.

10. The combination of claim 1 wherein said second leg and said element include coacting means supporting said element for at least slight lateral shifting relative said second leg.

* * * * *